US009855493B1

(12) United States Patent
Pratt

(10) Patent No.: US 9,855,493 B1
(45) Date of Patent: Jan. 2, 2018

(54) PUZZLE PIECES

(71) Applicant: Patty Pratt, Redondo Beach, CA (US)

(72) Inventor: Patty Pratt, Redondo Beach, CA (US)

( * ) Notice: Subject to any disclaimer, the term of this patent is extended or adjusted under 35 U.S.C. 154(b) by 0 days.

(21) Appl. No.: 14/725,212

(22) Filed: May 29, 2015

Related U.S. Application Data

(60) Provisional application No. 62/005,382, filed on May 30, 2014.

(51) Int. Cl.
*A63F 9/10* (2006.01)
*A63F 9/12* (2006.01)

(52) U.S. Cl.
CPC ..... *A63F 9/12* (2013.01); *A63F 9/1044* (2013.01); *A63F 2009/1022* (2013.01); *A63F 2009/1038* (2013.01)

(58) Field of Classification Search
CPC ..... A63F 9/10; A63F 9/12; A63F 2009/1038; A63F 2009/1033; A63F 2009/1027; A63F 2009/1022; A63F 2009/1088; A63F 2009/1044
See application file for complete search history.

(56) References Cited

U.S. PATENT DOCUMENTS 2,003,845 A * 6/1935 Whitcomb ..... A63F 9/1044 273/157 R
T984,007 I4 * 7/1979 Richardson ..... A63F 9/10 156/220
4,699,385 A * 10/1987 Bifulco ..... A63F 3/0023 273/157 R
4,937,181 A * 6/1990 Rogers ..... G09B 1/06 273/157 R
5,158,295 A * 10/1992 Shilling ..... A63F 9/1044 273/157 R
5,213,507 A * 5/1993 Ozrovitz ..... A63F 9/10 273/157 R
5,219,168 A * 6/1993 Morris ..... A63F 9/1044 273/157 R
5,251,900 A * 10/1993 Gallant ..... A63F 9/10 273/157 R
5,259,763 A * 11/1993 Wendel ..... G09B 1/06 434/150
5,405,146 A * 4/1995 Washington ..... A47G 1/0605 273/157 R
5,536,009 A * 7/1996 Edwards ..... A63F 9/10 273/157 R
5,544,882 A * 8/1996 Sarkar ..... A63F 9/12 273/157 R
5,735,521 A * 4/1998 Klimpert ..... A63F 9/10 273/157 R
5,820,124 A * 10/1998 Lawrence ..... A63F 9/10 273/157 R
5,865,928 A * 2/1999 Lariviere, Jr. ..... A63F 9/10 156/256
6,626,678 B2 * 9/2003 Forbes ..... A63F 9/0666 273/153 R
(Continued)

*Primary Examiner* — Steven Wong
(74) *Attorney, Agent, or Firm* — Brian S. Steinberger; Law Offices of Brian S. Steinberger, P.A.

(57) ABSTRACT

Puzzle pieces, puzzle piece compositions, puzzle piece fastening devices and systems, assembled puzzle mounts and systems and methods of fastening and assembling different layers together to form puzzle pieces. Mounting assemblies for the puzzles and support structures and methods for customizing and the decorating of puzzle pieces and assembled puzzles.

15 Claims, 11 Drawing Sheets

(56) References Cited

U.S. PATENT DOCUMENTS

| | | | | |
|---|---|---|---|---|
| 2002/0043760 | A1* | 4/2002 | Gallant | A63F 9/10<br>273/157 R |
| 2002/0105138 | A1* | 8/2002 | Juenger | A63F 9/12<br>273/157 R |
| 2008/0018048 | A1* | 1/2008 | Chiu | A63F 9/1011<br>273/157 R |

* cited by examiner 10
1A
1B
22
23
20
26
27
1
30

20

23
22
20

3C
23
3B
27
22
24
26
20

100
117
125
120
115
110
112

110
1
1
120
100

100
10

PUZZLE PIECES

This application claims the benefit of priority to U.S. Provisional Patent Application Ser. No. 62/005,382 filed May 30, 2014, which is incorporated by reference in its' entirety.

FIELD OF INVENTION

This invention relates to puzzles, and in particular to novel puzzle pieces, puzzle piece compositions, puzzle piece fastening devices and systems, assembled puzzle mounts and systems and methods of fastening and assembling puzzle pieces together, mounting assembled puzzles to support structures and customizing the decorating of puzzle pieces and assembled puzzles.

BACKGROUND AND PRIOR ART

Known jigsaw puzzles include pieces shaped to interlock with one another so as to form a picture, and/or to display a single image, and do not allow the person assembling the puzzle to create their own design(s).

One of the most popular types of jigsaw puzzles includes a large number of small irregularly cut pieces that are to be fitted together to form a picture. The whole picture is printed on individual ones of the pieces with the conventional printing technique. For the purchaser of the jigsaw puzzle, it is fun assembling the jumbled jigsaw pieces into a complete picture.

Other types of the jigsaw puzzles are printed with a monotonous pattern, a single color, or a graded color to make the puzzles more difficult to put together. Those types of puzzles are produced in large quantity on the commercial basis and are not therefore individualized for the needs of particular persons. There is also the custom jigsaw puzzle using the customer's photo.

Forming a puzzle usually requires one to work on the puzzle on a horizontal surface. When finished, the assembled puzzle is difficult to display standing up since the loose puzzle pieces can easily fall out over time. Using adhesive, such as glue to fix the puzzle pieces together to allow for a vertical orientation usually results in destroying the puzzle since this permanent fix does not allow the user to disassemble the puzzle for later assembly down the road.

Still furthermore, assembled puzzle pieces have no surfaces for displaying other decorations thereon, such as for supporting additional layers of puzzle pieces.

Thus, the need exists for solutions to the above problems with the prior art.

SUMMARY OF THE INVENTION

A primary objective of the present invention is to provide novel puzzle pieces, puzzle piece compositions.

A secondary objective of the present invention is to provide puzzle piece fastening devices and systems, assembled puzzle mounts and systems.

A third objective of the present invention is to provide methods of fastening and assembling puzzle pieces together, mounting assembled puzzles to support structures and customizing the decorating of puzzle pieces and assembled puzzles.

A puzzle piece for use with assembling a puzzle that includes a top layer having an upper surface for being separately decorated, and a lower surface, a foam layer having an upper surface adhered to the lower surface of the top layer, and a lower surface an adhesive layer adhered to the lower surface of the foam layer, a fabric layer having an upper surface attached to the adhesive layer on the lower surface of the foam layer, the fabric layer having fasteners, selected from at least one of hooks and loops, wherein the top layer and the foam layer and the adhesive layer and the fabric layer have perimeters with protruding portions and indented portions to allow the puzzle piece to be interconnected to other puzzle pieces.

The top layer can include an applied paint, acrylics, latex or other).

The top layer can include a fabric attached to the upper surface of the foam by an adhesive.

The top layer can include paper attached to the upper surface of the foam by an adhesive (standard white glue or other) with a preprinted design or not).

The top layer can include alcohol pens (or permanent markers).

The puzzle piece can include a rigid layer between the fabric layer and the foam layer.

A mounting system for assembled puzzle pieces, can include a plurality of puzzle pieces interlocked with one another to form an assembled puzzle having a substantially planar exterior surface, each of the puzzle pieces having a rear surface with a fabric having fasteners selected from at least one of hooks and loops, and a mount member having a surface portion with hooks and loops for attaching the assembled puzzle in a vertical orientation to support.

The mounting system can include an I shaped attachment having upper and lower horizontal legs with a stem portion therebetween, the upper and lower legs having exterior surfaces with fasteners, selected from at least one of hooks and loops for stacking additional puzzle pieces to an exterior surface of the assembled puzzle.

The mounting system can include an clip brackets having a rear surface which attaches by hook or loop fasteners to the assembled puzzle pieces, and an opposite clip end which is attachable about shelf edges.

The mounting system can include an L shaped bracket having an exterior portion with hooks and loops for attaching the mount to the hooks and loops on the rear surface of the fabric of at least one selected puzzle piece, the L shaped bracket being adapted to be attached to a corners of a support surface.

The mounting system can include a table top stand having posts with fasteners attached thereon for supporting the assembled puzzle pieces in an upright position.

The mounting system can include a triangular stand having a triangular section with a bent side section with fasteners for supporting the assembled puzzle pieces in an upright position.

The mounting system can include a rigid inner frame with fasteners for supporting the assembled puzzle pieces therein.

The mounting system can include a rigid outer frame with an inner compartment for supporting the rigid inner frame therein.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
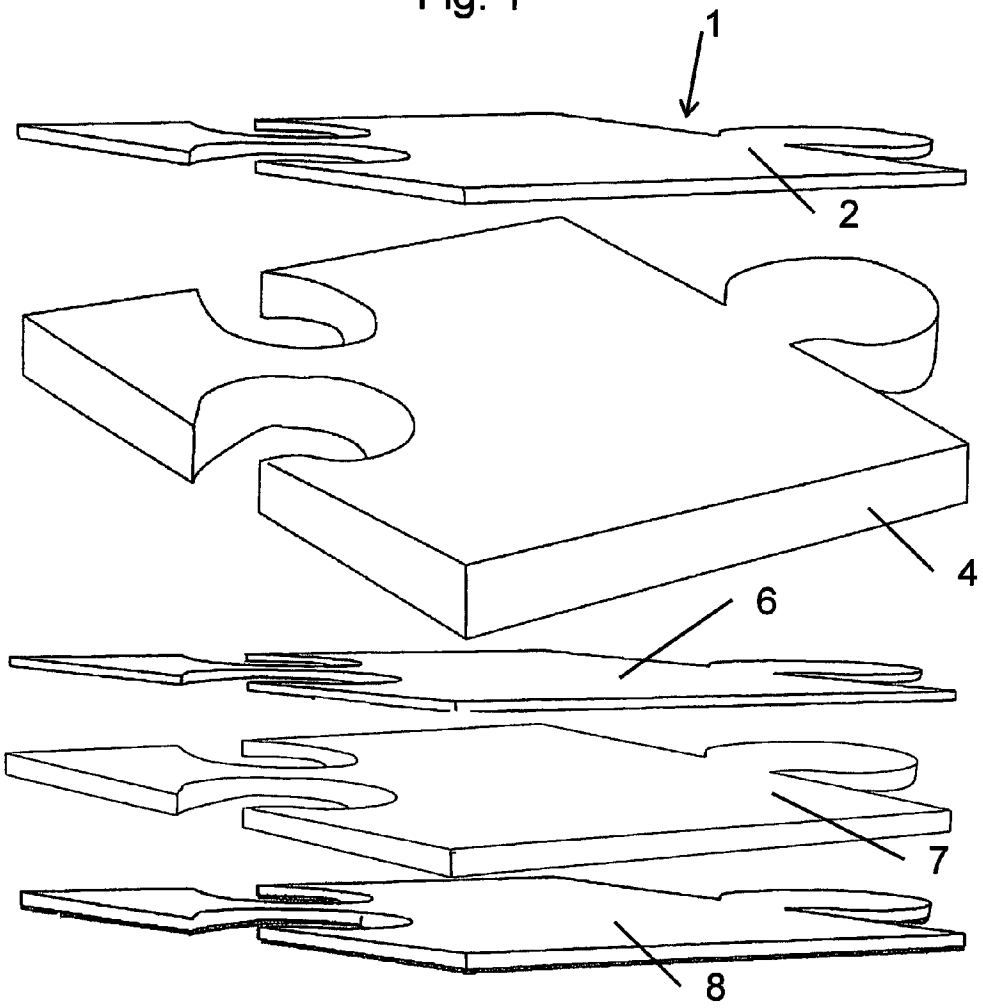
FIG. 1 is an exploded view of a novel puzzle piece for use with the invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 puzzle piece
2 top layer
4 foam layer
6 adhesive layer
7 optional rigid layer
8 loop fabric layer
10 assembled puzzle of puzzle pieces with additional puzzle pieces attached thereon
20 riser/spacer (H shaped on side or I shaped mount)
22 top
23 fastener layer
24 stem
26 base
27 fastener layer
30 attachment pieces
40 shelf bracket
42 upper leg of clip
44 lower leg of clip
46 front of bracket
45 fastener layer
49 shelf
50 window/shelf corner bracket
52 Flat L shaped base
53 fastener layer
54 raised L shaped flange
60 window frame
62 inside corner of window
70 foam art board
72 foam
73 adhesive
74 rigid board
75 adhesive
76 fastener layer
80 table top stand
82 base
84 posts
85 fastener layers wrapped/attached to posts
90 triangular stand
92 triangle side
94 enlarged base
95 top of triangle side

96 elongated bent side post
97 fastener layer on side post
100 wall frame assembly
110 rigid back frame
112 rough surface (such as sandpapered surface)
115 compartment
117 fastener layer (hooks)
120 removable rigid inner frame
125 strips of fasteners (hooks)
130 wristband embodiment
132 puzzle pieces
136 hook and loop band
140 hexagon puzzle piece FIG. 1 is an exploded view of a novel puzzle piece 1 for use with the invention. The invention can use multiple puzzle pieces having the novel composition layers depicted in FIG. 1. Each puzzle piece can include several layers that include a top layer 2, a foam layer 4, a thin base layer 6 and a loop and/or hook fabric layer 8 with loops and/or hooks facing downward. A preferred embodiment of the fabric layer 8 is to only have loops facing downward. An optional rigid layer 7 can be used between the adhesive layer 6 and loop fabric layer 8.

The top exposed layer 2 can be a factory applied paint, fabric or paper (printed or blank), DIY (do it yourself) acrylics, peel-off adhesive, glued on crafts or fabric. Optionally, a fabric and paper top layer 2 requires a separate adhesive layer underneath or industrial adhesive for attaching to foam layer 4.

The foam layer 4 can be an open cell (fire rated) or closed cell (fire rated) foam, that is acceptable for use in schools as window treatments. The foam layer 4 can be of various sizes and thicknesses, such as but not limited to 2"×2", 3"×3", 5"×5", and 7"×7".

Table 1 lists various thicknesses for the different puzzle piece sizes.

TABLE 1

| Puzzle Piece Size | Thickness |
|---|---|
| 2" × 2" | 0.125" |
| 3" × 3" | 0.25" |
| 5" × 5" | 0.3125" |
| 7" × 7" | 0.375" |

Presently, there are two types of foam that are being used. (There are several others that could be used that can include different colors and composites) The two that are chosen now are 1) closed-cell which is excellent for art creations, painting upon with acrylics and doing general crafts with children. 2) open-cell which is a special foam that has the highest UL fire rating and is good for factory-finished puzzle piece products like pre-painted (non-acrylic based paints) and/or fabric coated. Those who want to DIY their own colors and paint it with oil based or spray paint (clearly for adults to do; not children) can buy the unfinished product which is safe for schools. The first type (closed-cell) is the more important one for this patent.

A preferable foam layer can expanded, closed cell, cross-linked polyethylene, or copolymers of polyethylene.

Underneath the foam layer 4, can be a thin adhesive layer 6, such as an industrial adhesive, which attaches an exterior fabric layer 8 preferably with hook and/or loop hanging attachments that can later attach to mounting fasteners having mateable loop and/or hook hanging attachments on surfaces. A preferred embodiment of the fabric layer can have only loops extending downward.

An optional rigid layer 7 can be used between the thin adhesive layer 6 and fabric layer 8. The rigid layer 7 can be formed from material, such as but not limited to wood, plastic, along with a lower facing adhesive layer which faces the fabric layer 8.

For each of the puzzle pieces, there can be various sizes available, two of the sizes can be approximate 5"×5", and 7"×7" pieces though other sizes can be used. All pieces come can come with a loop backing for hanging on a hook fastener. The front face is the foam itself in most cases, though colored fabric, peel-off adhesive and adhered paper are potential products that could and should be protected.

Kits can be sold as DIY sets OR in complete craft sets (including the paint, glue and/or some type of small pieces for gluing like buttons, paper, tissue paper, Popsicle sticks, foam pieces, alphabet letters, glitter, stickers, sequins, wooden pieces, fabric scraps, etc.).

Otherwise crafters can purchase crafting supplies and notions separately for DIY sets. Complete craft kits and the DIY versions can be sold in sets of 12 (current marketed product) where the outside edge is rectangular and makes a puzzle or as single pieces though larger sets and irregular edges should be protected. Another completed craft kit is a hook/loop fastener band with 2-6 pieces as a wristband.

Some sets can come with designs to transfer to the puzzle pieces before crafting or painting. Foam puzzle pieces can also be used as the media for formal art projects. The pieces can be used separately or with a class of students. Hook backed fasteners (sticky-backed-sew on or other) can be used to display the artwork. Hook fastener comes with the novel pieces.

Spray paint can be used on the open cell foam but won't stick very well to the closed cell foam.

Figure 2A:
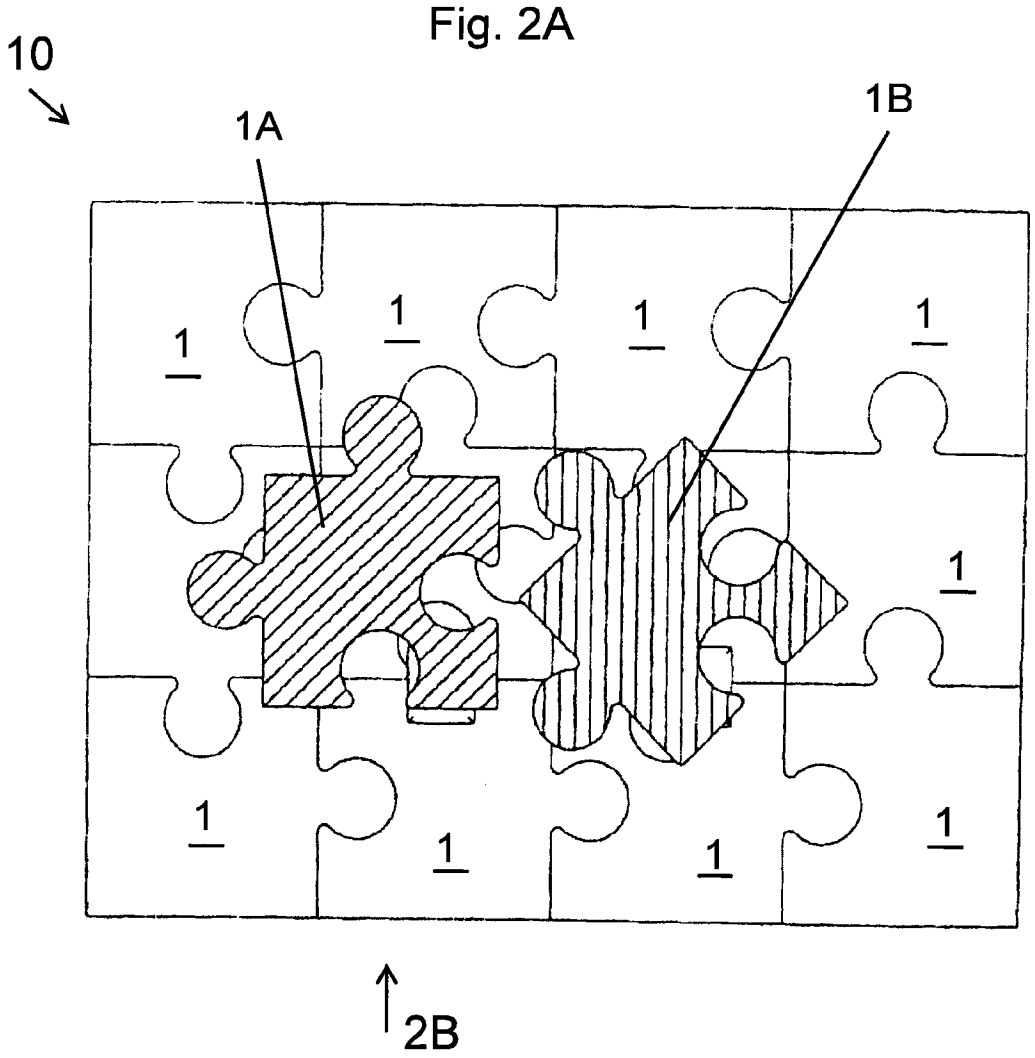
FIG. 2A is a front view of a hanging assembled puzzle with the puzzle pieces of FIG. 1.
Figures 2B, 3A, 3B, 3C:
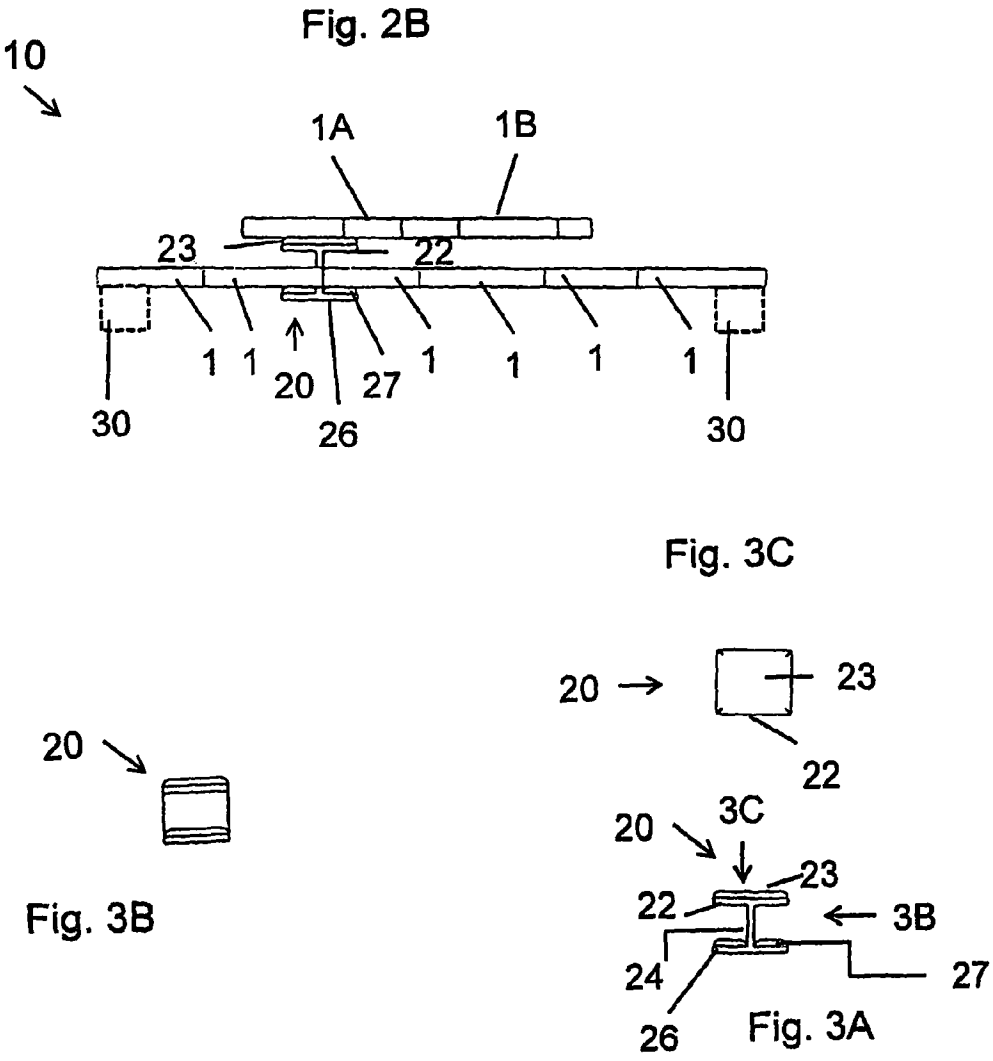
FIG. 2B is a side view of the hanging assembled puzzle of FIG. 2A along arrow 2B.
FIG. 3A is a side view of a riser/spacer used to attach an extra puzzle piece to an assembled puzzle.
FIG. 3B is a side view of the riser/spacer of FIG. 3A along arrow 3B.
FIG. 3C is a top view of the riser/spacer of FIG. 3A along arrow 3C.

FIG. 2A is a front view of a hanging assembled puzzle with the puzzle pieces of FIG. 1. FIG. 2A shows an assembled puzzle 10 that uses the novel puzzle pieces 1 of FIG. 1 assembled together that can be hung from support surfaces, such as but not limited to a wall, a bookshelf and/or other types of vertical or upright surfaces. FIG. 2B is a side view of the hanging assembled puzzle of FIG. 2A along arrow 2B.

FIG. 3A is a side view of a riser/spacer 20 used to attach an extra puzzle piece 1A, 1*b* to an assembled puzzle. FIG. 3B is a side view of the riser/spacer 20 of FIG. 3A along arrow 3B. FIG. 3C is a top view of the riser/spacer 20 of FIG. 3A along arrow 3C. The riser/spacer 20 can include a top 22, fastener layer 23 (such as a hooks), stem 24, base 26, with additional fastener layer 27 (such as hooks).

Referring to FIGS. 2A, 2B, 3A, and 3B, additional foam shapes, 1A, 1B can be attached to the front outer surface of the assembled puzzle at various locations by using a hook and loop backing (such as loops), and shows the use of additional hook attachment pieces for mounting the assembled puzzle to support surfaces.

Riser 20 can have an H shape when laid on its' side with the top 22 having a hook and loop fastener layer 23 (preferably hooks), and on the base 26 can also have a hook and loop fastener layer 27 (preferably hooks). A stem portion 24 can attach the top 22 to the base 26.

Novel riser/spacer(s) 20 allows for the additional puzzle pieces 1A, 1B to rise above an assembled puzzle. The stem 24 can be positioned between side by side assembled puzzle pieces 1, with the upper fastener layer 23 below an additional puzzle piece(1A, 1B) which can have a lower fastener layer of loops that attaches to the hooks on the fastener layer 23.

The riser/spacer (H shaped mount) 20 can allow for plural puzzle pieces 1 to be attached to both the front and rear surfaces of assembled puzzle pieces in stacked arrangements. This novel mount 20 can fit between assembled puzzle pieces, and having a capital I cross-sectional shape, so that upper protruding portions allow for additional puzzle pieces to be layered on top of the puzzle pieces and/or on the back of the puzzle pieces.

This mount 20 can be formed from materials, such as but not limited to wood, plastic, or fabric, with can include surface portions that have adhesive and/or fasteners, such as but not limited to hooks and/or loops.

Separate attachment pieces 30 can have upper fastener layer(s) such as hooks which attach to the lower facing loops on the puzzle pieces 1.

Attachment pieces 30 can include but are not limited to bookshelf clips, peel and sticky tape having hook and loop fasteners or corner bracket which will be described in reference to the next drawings.

With the invention, the user can customize their own designs on the outer surface of the assembled puzzle or on each piece separately before the puzzle pieces are assembled.

Figure 4B:
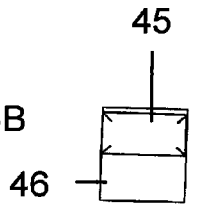
FIG. 4B is a front end of the shelf bracket of FIG. 4A along arrow 4B.
Figure 4C:
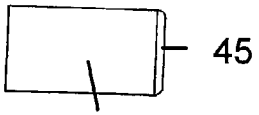
FIG. 4C is a top view of the shelf bracket of FIG. 4A along arrow 4C.
Figure 4A:
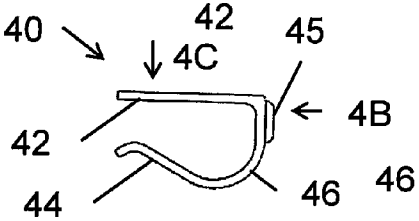
FIG. 4A is a side view of a novel shelf bracket for use with the novel puzzle pieces.

FIG. 4A is a side view of a novel shelf bracket 40 for use with the novel puzzle pieces 1 and the assembled puzzle 10 previously described. FIG. 4B is a front end of the shelf bracket 40 of FIG. 4A along arrow 4B. FIG. 4C is a top view of the shelf bracket 40 of FIG. 4A along arrow 4C.

Referring to FIGS. 4A-4C, shelf bracket 40 can be formed from a rigid material, hard plastic or stiff foam, with a hook and/or loop fabric (preferably hooks) adhered to at least a part of the exterior surface Shelf bracket 40 can include an upper leg 42 of a clip portion with a lower angled leg 44 of the clip portion, a front 46 with a fastener layer, such as hooks attached by an adhesive thereon.

Figure 5:
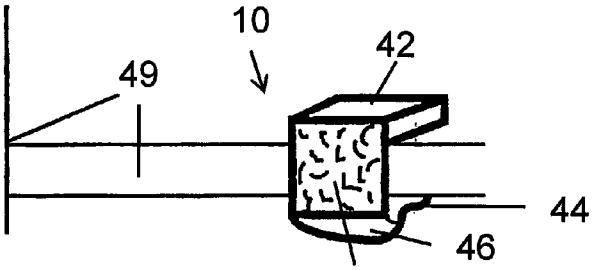
FIG. 5 is a perspective view of the front of the shelf bracket of FIGS. 4A-4C clipped to a shelf.

FIG. 5 is a perspective view of the front 46 with fastener layer 45 (hooks) of the shelf bracket 40 of FIGS. 4A-4C with clip legs 42, 44 clipped to a shelf 49.

Figure 6:
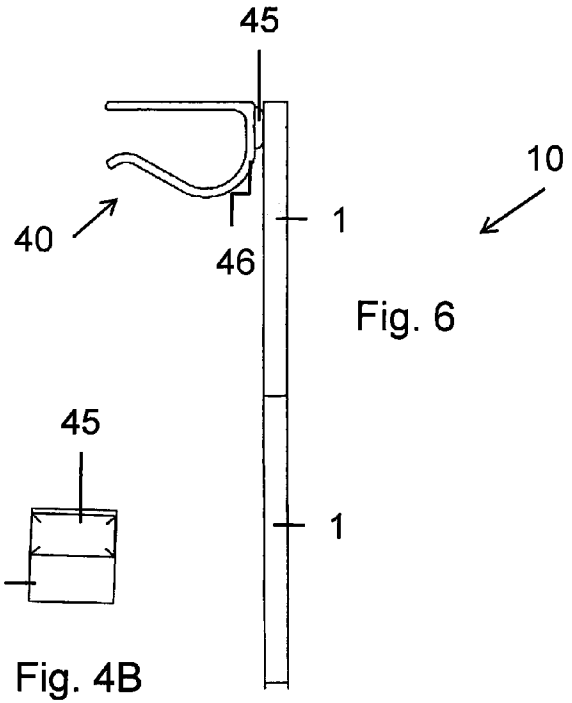
FIG. 6 is a side view of the shelf bracket of FIGS. 4A-4C attached to a back of an assembled puzzle.

FIG. 6 is a side view of the shelf bracket 40 of FIGS. 4A-4C with fastener layer (of hooks) attached to a back layer (loops) of an assembled puzzle 1.

Figure 7A:
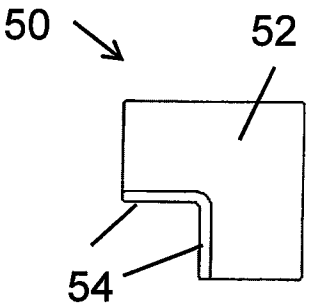
FIG. 7A is a top view of a novel window/shelf corner bracket.
Figure 7B:
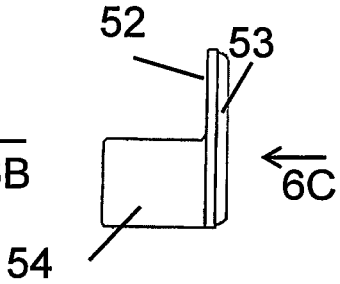
FIG. 7B is a side view of the corner bracket of FIG. 7A along arrow 6B.
Figure 7C:
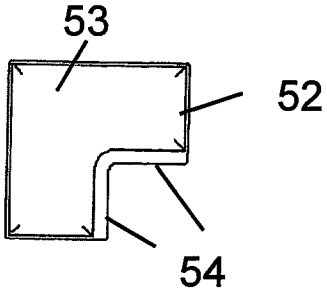
FIG. 7C is a bottom view of the corner bracket of FIG. 7B along arrow 6C.

FIG. 7A is a top view of a novel window/shelf corner bracket 50. FIG. 7B is a side view of the corner bracket 50 of FIG. 7A along arrow 6B. FIG. 7C is a bottom view of the corner bracket 50 of FIG. 7B along arrow 6C.

Corner bracket 50 can be formed from a rigid material, hard plastic or stiff foam, with a hook and/or loop fabric (preferably hooks) adhered to at least a part of the exterior surface.

Corner bracket 50 can include a flat L shaped base 52 with an outer fastener layer 53 (preferably hooks) on the bottom and a raised L shaped flange 54 on the top side of the bracket 50.

Figure 8B:
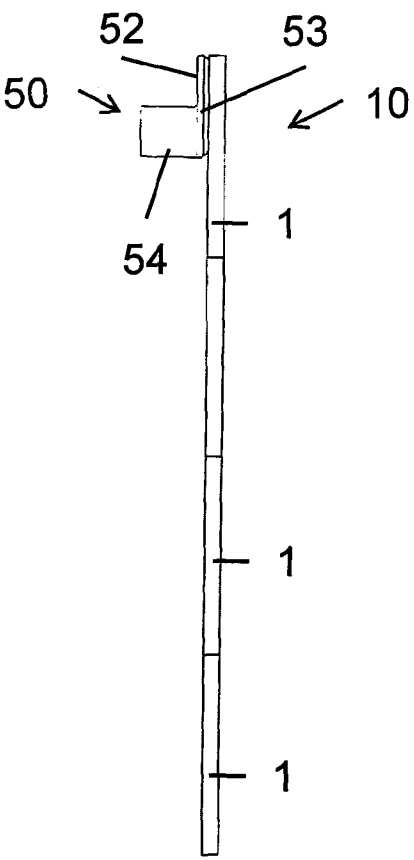
FIG. 8B is a side view of the assembled puzzle with attached corner brackets of FIG. 8A along arrow 7B.
Figure 8A:
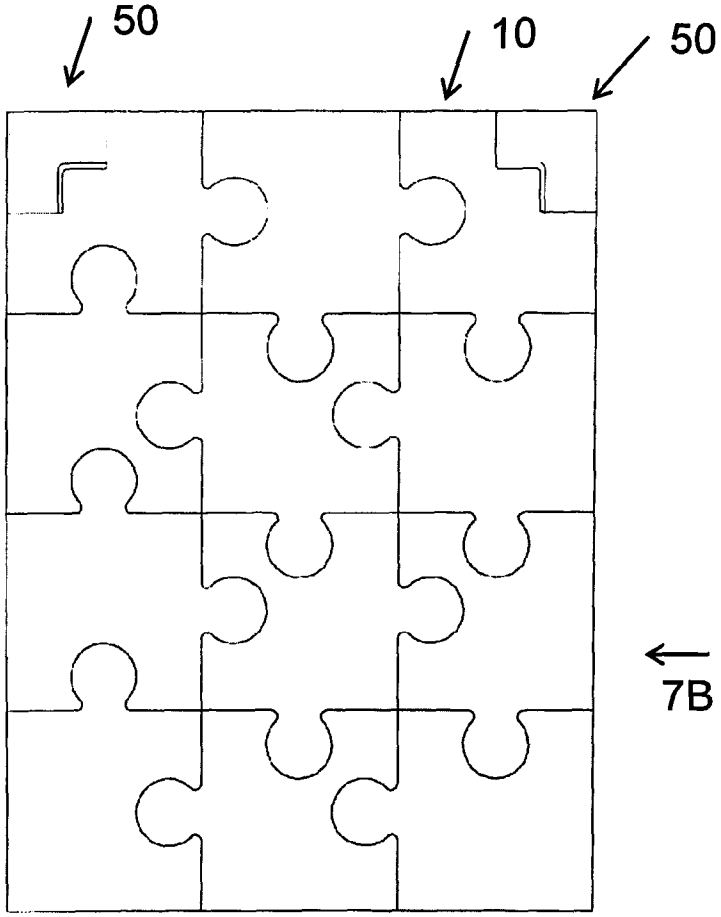
FIG. 8A is a bottom view of an assembled puzzle with the corner brackets of FIGS. 7A-7C attached thereon.

FIG. 8A is a bottom view of an assembled puzzle 10 with the corner brackets 50 of FIGS. 7A-7C attached thereon by the fastener layer 53 (such as hooks) attached to the fabric layer (such as hoops) on the back of the puzzle pieces. FIG. 8B is a side view of the assembled puzzle 10 with attached corner brackets 50 of FIG. 8A along arrow 7B.

Figure 9B:
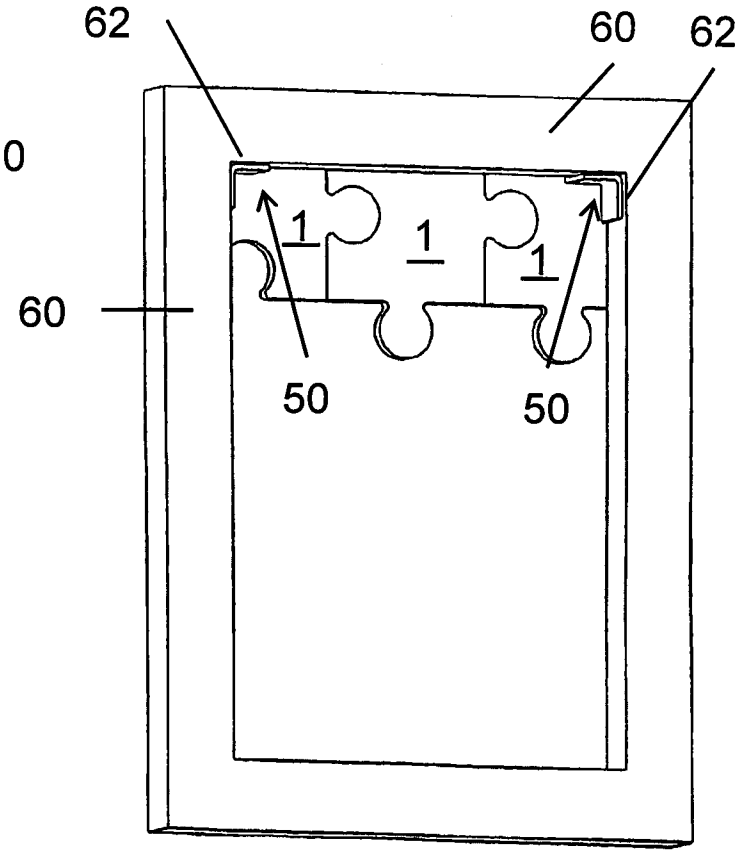
FIG. 9B is a rear perspective view of the partial assembled puzzle pieces mounted inside the window frame of FIG. 9A.
Figure 9A:
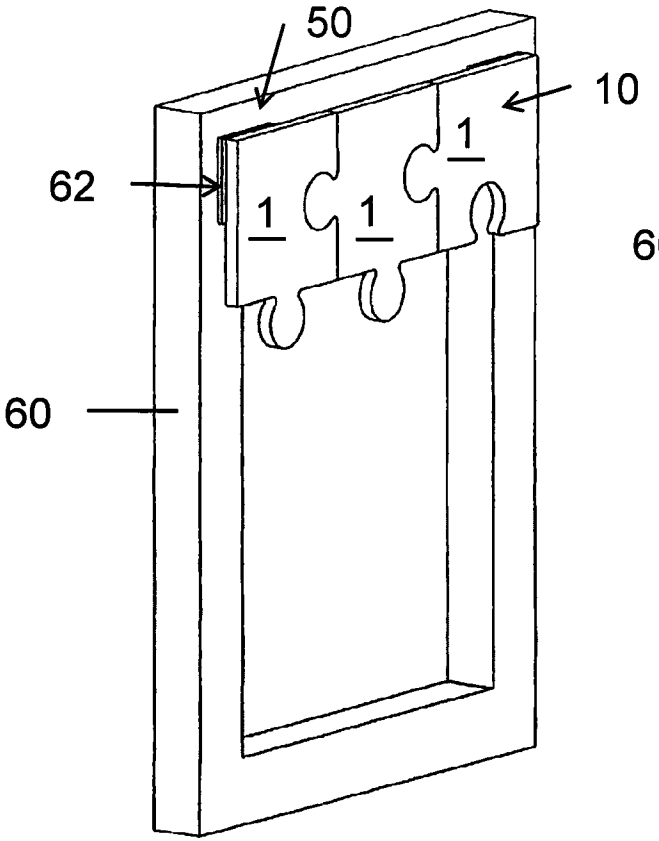
FIG. 9A is a front perspective view of a partial assembled puzzle pieces mounted to inside frame corners of a window.

FIG. 9A is a front perspective view of a partial assembled puzzle pieces 1 mounted to inside frame corners 62 of a window frame 60. FIG. 9B is a rear perspective view of the partial assembled puzzle pieces 1 mounted inside the window frame 60 of FIG. 9A.

The corner brackets 50 can be attached by screws and the like, to a corner surface 62 inside the window frame 60, or by an adhesive surface (such as peel and stick tape), and/or by using hook and/or loop fasteners, and the like. As the puzzle pieces are significantly light weight, museum wax can also be used to securely hold the corner bracket to the shelf or window.

While a window frame with inside corners is shown, the invention can be applied to outer corners of the window frame. Additionally other support corner surfaces such as corners where a shelf meets a sidewall can be used with the novel corner brackets 50.

Figure 10B:
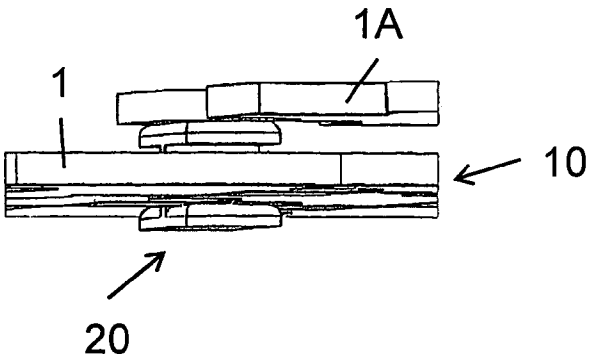
FIG. 10B is an enlarged view of a portion of FIG. 10A.
Figure 10A:
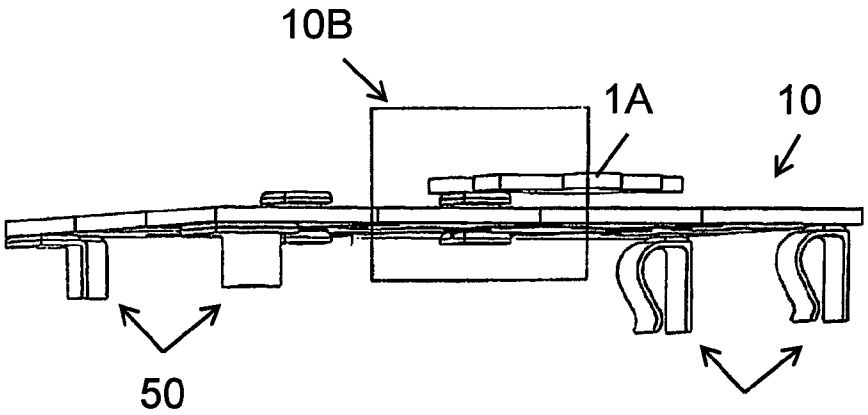
FIG. 10A is a side perspective view of an assembled puzzle pieces with additional stacked puzzle pieces attached by an I mount, along with shelf brackets and corner brackets.

The invention can use a combination of the different novel features described and shown in the drawings. FIG. 10A is a side perspective view of an assembled puzzle pieces 10 with additional stacked puzzle piece(s) 1A attached by an I mount 20, along with shelf brackets (clips) 40 and corner brackets 50. FIG. 10B is an enlarged view of a portion of FIG. 10A showing stacked puzzle pieces 1, 1A.

Figure 11A:
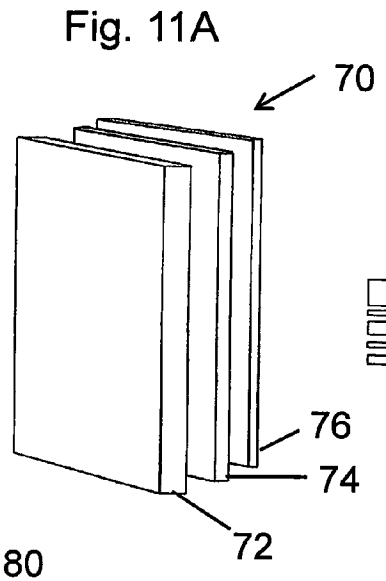
FIG. 11A is a perspective exploded view of an art board using novel features of the puzzle piece invention.
Figure 11B:
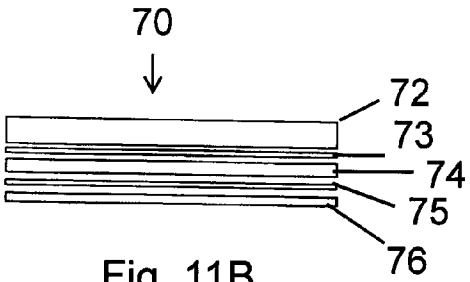
FIG. 11B is an exploded side view of the board of FIG. 11A.

FIG. 11A is a perspective exploded view of an art board 70 using novel features of the puzzle piece invention. FIG. 11B is an exploded side view of the board 70 of FIG. 11A. The fine art board 70 can include a foam layer 72, adhesive surface on side 73 for attaching to a rigid board 74, such as but not limited to wood and plastic. On the other side of the rigid board 74 and be another adhesive layer 75 which attaches to a fastener layer 76, preferably having loops. The different layers can be formed from the same materials used in the novel puzzle piece(s) 1 previously described.

Figure 12:
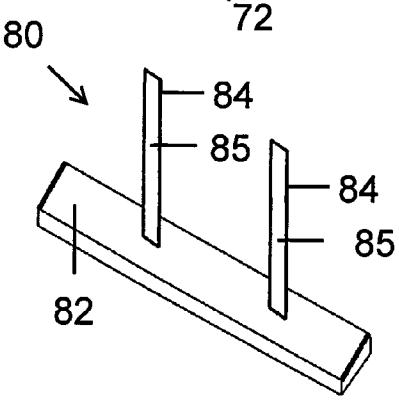
FIG. 12 is a perspective view of a table top stand for use with the novel art board of FIGS. 11A-11B and novel puzzle pieces.

FIG. 12 is a perspective view of a table top stand 80 for use with the novel art board 70 of FIGS. 11A-11B and novel puzzle pieces 1, and assembled puzzle 10 previously described. Stand 80 can include a base 82 for sitting on a table top. Extending upward from the base 72 can be posts 84, each can be wrapped or attached with hook and loop type fastener tape, and the like.

Table top stand 80 can be formed from rigid materials, such as but not limited to wood or plastic. The novel assembled puzzle 10 and/or the novel foam art board 70 can have its fastener layer 76 attached to hooks on the fastener layer 85 about the posts 84 so that the assembled puzzle 10 and/or fine art board is supported in a vertical direction.

Figure 13:
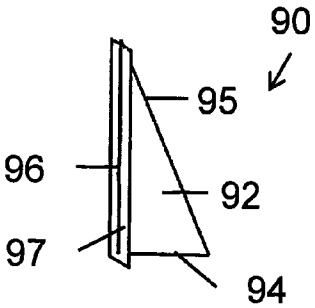
FIG. 13 is a perspective view of a triangle stand for holding assembled puzzle pieces and/or the novel art board.

FIG. 13 is a perspective view of a triangle stand 90 for holding assembled puzzle pieces 10 and/or the novel art board 70. Triangle stand 90 can include a triangle side 92 with an enlarged base 94 and narrow top 95, wherein the base 94 with bottom of the bent side post 96 can allow for the triangular stand to be in an upright position. Fastener layer 97, such as hook and loop tape can be wrapped or attached to part of the stand 90 such as the outer side of the elongate bent side post 96.

Triangle stand 90 can be formed from rigid materials, such as but not limited to cardboard, wood or plastic. Loop fastener layer 76 on fine art board 70 or loop fasteners on assembled puzzle pieces 10 previously described can be attached to hook fasteners 97 on triangular stand 80 so that the assembled puzzle 10 and/or fine art board can be supported in a vertical direction.

Figures 14, 15, 16:
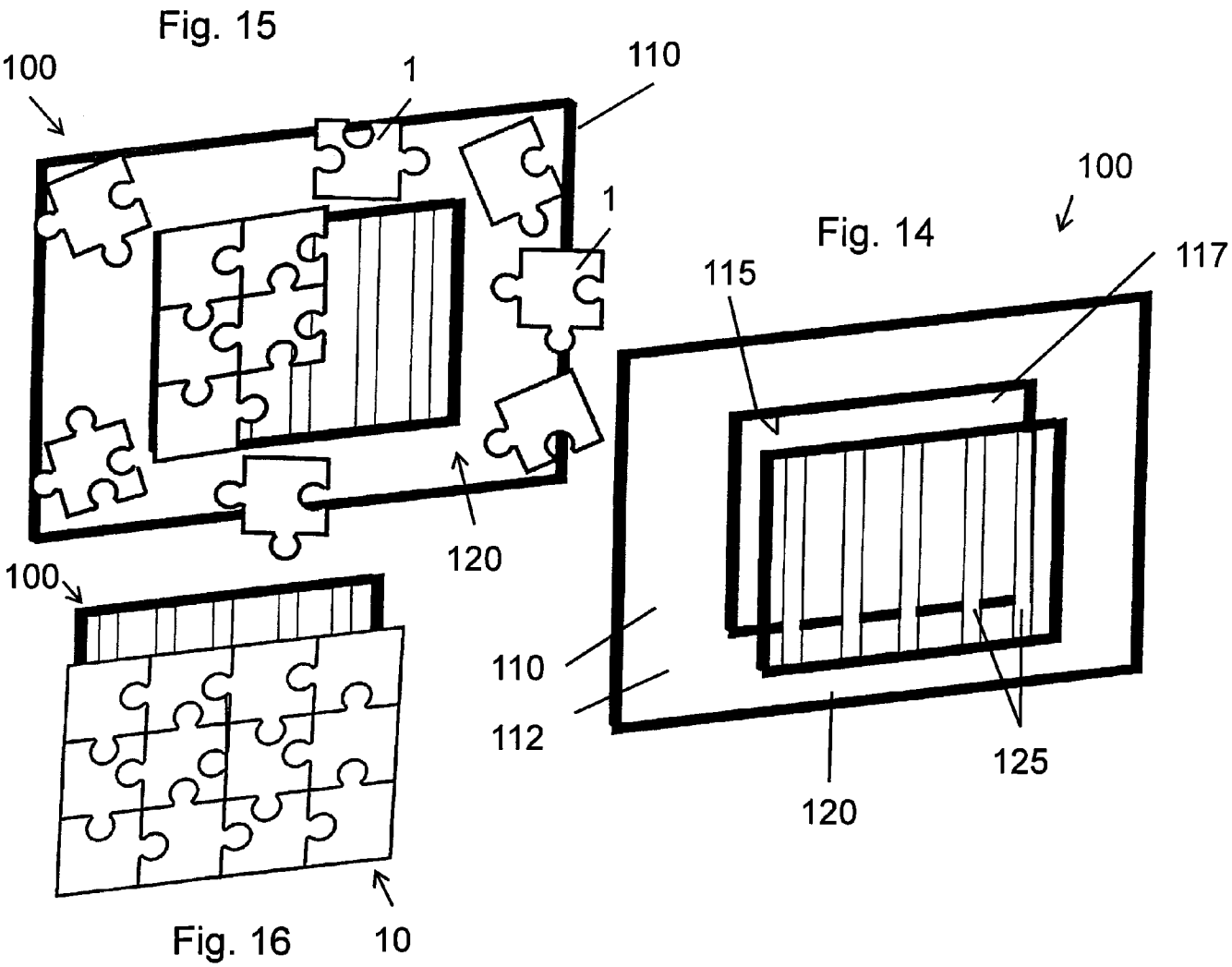
FIG. 14 is an exploded view of a rigid back assembly frame with removable rigid inner frame for use with puzzle pieces.
FIG. 15 is a partial assembled view of the rigid inner frame attached to the rigid back assembly of FIG. 14 with puzzle pieces being attached.
FIG. 16 is an assembled view of FIG. 15 with all puzzle pieces attached.

FIG. 14 is an exploded view of a wall frame assembly 100 having a rigid back frame 110 with removable rigid inner frame 120 for use with puzzle pieces 1. FIG. 15 is a partial assembled view of the rigid inner frame 120 attached to the rigid back frame of FIG. 14 with puzzle pieces 1 being attached. FIG. 16 is an assembled view of FIG. 15 with all puzzle pieces 1 attached.

A rigid back frame 110 can be attached to a wall type surface by conventional fasteners, such as screws, hook and loop fasteners and the like. The rigid back frame 110 can include an outer surface 112 that can have a rough surface (such as sandpapered surface) to temporarily hold puzzle pieces 1 thereon such that the assembly of the puzzle can be done vertically on the wall without the pieces adhering tightly, making it easy to try different configurations, and hook fasteners inside the compartment 115 to hold the inner frame 120.

The removable rigid inner frame 120 can have strips of hook fasteners 125 on front to attach to the puzzle pieces 1 as previously described, and loop fasteners on back to stick to hook fasteners inside compartment 115 Puzzle pieces can stick durably to hook fasteners and lightly to rough surfaces allowing the puzzle pieces 1 to be moved and easily removable on the inner frame 120 when the puzzle is complete.

Figure 17:
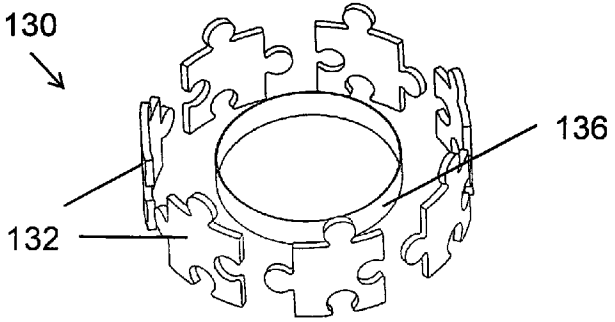
FIG. 17 is an exploded view of a cylindrical arrangement of puzzle pieces about band of hook and loop fasteners.
Figure 18:
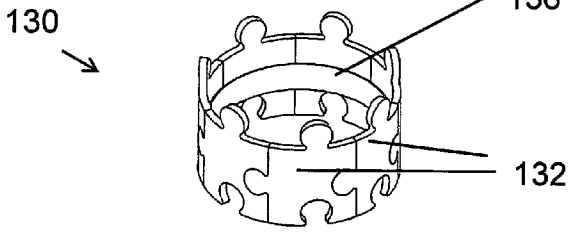
FIG. 18 is an assembled view of the puzzle pieces of FIG. 17 useful as a wristband.

FIG. 17 is an exploded view of a cylindrical arrangement for a wrist band embodiment 130 of puzzle pieces 132 about a band of hook and loop fasteners 136. FIG. 18 is an assembled view of the puzzle pieces 132 of FIG. 17 useful as a wristband. A strip/band of hook and loop fasteners can be attached into a ring configuration with the fasteners (hooks) extending outward so at to attach to fasteners (loops) on the puzzle pieces 132. The puzzle pieces 132 can be similar to the novel puzzle pieces 1 previously described and here be allowed to curve and bend and have a loop fastener surfaces.

Additionally, different sizes can allow for the cylindrical arrangement of puzzle pieces to wrap about posts and columns, and the like.

Figure 19:
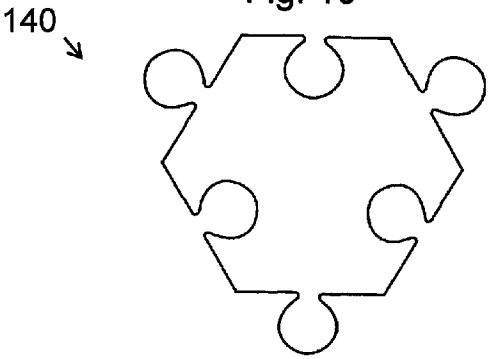
FIG. 19 is a perspective view of another puzzle piece that can be in a hexagon shape.

FIG. 19 is a perspective view of another puzzle piece that can be in a hexagon shape 140 that can be used with the previously described and shown embodiments. The hexagonal piece allows the user to add to the number of pieces endlessly without constraints of corners or borders Adding a single piece for commemorative display like memory quilts can be used to remember town war heroes or cancer survivors).

While the invention describes assembling the puzzle in a traditional horizontal orientation, such as on a floor or table, the invention can have the novel puzzle pieces assembled in a vertical or angled orientation with the assembler standing up. For example, the puzzle pieces can be assembled directly on a board type substrate such as a traditional artist's drawing board, a corkboard, and the like. The board can have a front surface with hook and loop fasteners such that each puzzle piece can be directly attached to the board. The board can be initially supported on an easel, where the board is angled or slanted. Next, the user can attach puzzle pieces directly to the easel supported board.

Also, the board can be pre-mounted in a vertical orientation, such as but not limited to being on a side of a wall, side of a bookcase, and the like, where the board is pre-attached to the wall or furniture, by an adhesive or by using hook and loop fasteners, and the like.

In both the slanted orientation and the vertical orientation, one can assemble the puzzle pieces while standing up.

The invention can be used in a variety of ways as previously seen in interlocking puzzle pieces or as a rectangle foam art board for professional artists. Additionally, the interlocking pieces can be made from an assortment of die cut shapes from a block of foam that is then die cut with a shape die (puzzle piece, animal, oval, or other shape). In this craft kit the die cut shape-piece can be removed from the block and both surfaces can be painted or decorated individually and reassembled where the outside piece serves as similar to a standard mat board that can be painted and decorated without risk of warping. Examples of a rectangle block with a puzzle piece cut-out and an oval cutout are shown. The foam block back piece can also be of varying shapes such as an oval. An example of an oval block is shown with a puzzle cutout. The foam block has the hook and loop fastener (preferably loop) applied before the die cut shape; therefore, the piece can be pushed back in the frame completely, partially or suspended with one of the shelf clips or risers.

The invention can be used with teaching students art, where the students become the artist for decorating the individual puzzle pieces and/or decorating the assembled puzzle.

The students can use the following materials and equipment referenced below, the preparation steps referenced below.

Materials and Equipment:

Foam Puzzle Piece with loop fabric backing for hanging; small amount of acrylic paint 1-3 analogous or adjacent colors on the color wheel (i.e. blue, purple and green; red, yellow and orange, or blue, cyan and green etc.); painter's tape (thin and wide); 3 paper towels one for each color; water. (optional 1 inch sticky-backed hook-side tape for hanging).

Preparation:

Sharpie or other type of marker can be used to write name on back of puzzle piece.

Each class (the whole class) and each individual student can be given the following supplies For Whole Class:

20-30 yards of painters tape per 25 children (preferably for delicate surfaces in various sizes); 1-3 pints or tubes (2-4 fl oz) of acrylic paint in a minimum of 3 colors; several paper bags for trash (used paper towels and painters tape removal); clothespins to hold the paper towels while painting (or sponge brushes); water and buckets available for students to wash their hands; optional (scissors).

For Individual Student:

3 paper towels; small cup of water; one foam puzzle piece with loop backing; ¼ teaspoon of 1-3 acrylic paint colors; approximately one yard of painters tape; one clothespin; scissor (optional).

Teachers using the invention can be given the following instructions for their students.

Introducing the Lesson:

First write name with black sharpie (or marker) on back (fuzzy side) of puzzle piece. Tell students "for every positive space there is a surrounding negative space."

Demonstrate how two sides of a puzzle piece have the exact same shape yet one is a positive element in art and the other a negative.

Pick up two puzzle pieces and interlock the one puzzle tab with another puzzle and break them apart. Point to the positive and negative space and have students identify them on their own piece.

Have students hold their puzzle piece up and look at something through the negative space and explain that the negative space defines a shape relative to the background. Tell them that everything behind the puzzle piece which is in the foreground is now in the negative space around the puzzle piece.

Still looking through the concave negative space of the puzzle edge, have students find something in the background of the room that they can look through like a window or chair legs.

Explain that the puzzle piece is positive in relationship to the window or chair legs and everything behind the window frame or chair legs is negative to that space. Ask students, "Why it is important in art to think about what's in the background of an object?" Allow them to answer. Guide the discussion to the conclusion that in art both the negative and positive space are equally important. Show examples of M.C. Escher or other artists, cave paintings and contemporary art, where positive and negative space are a primary part of the artwork.

The following activities can be given to the students.

Activities:

Pass out strips of paper towels or have student rip. Have students fold the paper towel lengthwise and then fold into padded surface so that part of the paper towel can be a handle for the clothespin to attach to.

For a THREE step multi-color process begin here →Quickly dip one edge of the paper towel (or sponge) in water to moisten the towel so it is wet but not saturated. Put ⅛ teaspoon or less of the lightest color paint directly on the wet part of the paper towel. Fold the paper towel to spread the paint on the padded surface. Wipe a light layer of paint onto the surface of the foam puzzle piece covering the entire piece.

TWO color (plus white) processes begin here→Make a design on the foam with painters tape by ripping (or cutting—optional) the tape into smaller and thin pieces and placing them directly on the newly painted surface or directly on the foam if white is the first color. Push the tape securely onto the surface.

Note: the newly painted surface does not need to be dry (particularly if Scotch 3M 2080EL delicate tape is used) but it can be. Be sure to push the tape securely onto the surface. Designs can be repetitive; linear; patterned, abstract, objective, non-objective or geometric. Fold a paper towel to make a pad and insert it into the clothespin. Load the next color onto the pad by first quickly dipping a corner of the paper towel in water and apply ⅛ medium hue color.

Fold the paper towel to spread the paint on the pad. Leaving the painters tape intact and using a blotting technique primarily and some wiping, spread the paint over the entire puzzle piece directly on top of the painters tape taking care to fill in the exposed areas. Paint should NOT be very wet.

ONE step process begin here→Use painters' tape (tear into small pieces or cut using scissors) to create a new and different shape directly on top of the other tape if there is any or directly on the foam puzzle piece if a one color process is being used and newly painted surface leaving some of the background color showing.

Apply next color to the paper towel (or get a new paper towel) and repeat the process first dipping in water then loading the paper towel pad with the third and final paint color.

Again fold the paper towel to spread paint. Paint the surface. The final painting application should be fairly thick to make the best contrast between earlier colors. This is critical to an overall successful project.

Allow a short amount of drying if possible; however, it is not critical. Have students peel the painters tape off the surface (tape the removed tape right inside the paper bags for easy trash disposal) to reveal the final Batik pattern. Tell students to look for the positive and negative in their finished projects.

An intended outcome of the lessons in the class can be as follows.

Intended Outcomes the Lesson:

Explore a creative process called resist; Become familiar with the design origins of positive and negative space; Discover heritage artists and artwork from all ages.

Perception and Response:

Identify positive and negative relationships between objects, shapes and forms; Freely create a design based upon exposure to historic art techniques that utilize various fundamental concepts of space.

Aesthetic Valuing:

Point out the positive and negative spaces in the finished artwork; removing the resist material (painters tape) to reveal the final art.

Creative Expression:

Choose from a wide variety of design options

Craftsmanship/Stewardship:

Attention to design; sequencing the steps

Integration and/or Extension Ideas:

Hawaiian patterns (hibiscus); dragonflies; use contrasting colors to explore how brown is created; use monochromatic color scheme (one color and black); hang artwork together in one display; Older students can use paint brushes to paint back into the spaces if desired or more simply to add small features like eyes where needed; Use black as the last color.

Additional Resources:

Batik video or pictures of process

Extended Vocabulary:

Resist Process; Wax resist; Analogous Colors

Technical Tips:

Allow time at the end to examine the work to reinforce the concepts; Allow times at the end to wash hands Summary:

Students discover negative and positive space in an experiential way and respond by creating a work that reinforces the concepts and implements a traditional art process of resist dyeing culminating in a unique puzzle-piece shaped artwork that can be displayed in a variety of ways.

The following are general cost estimates for using the invention with students.

Cost Analysis

Foam Puzzle Piece –1 (wholesale*10,000 min) 0.80¢
Paint ~0.17 oz. 0.12¢
Painters Tape (1 yard preferred 2 sizes narrow & 1 in). 08 ¢
Sticky-backed hook fastener tape ¾ in. (optional) 0.02¢
Total $1.01
Incidental materials needed can include:
Paper towels
Water
Cups for water
Sharpie (or marker) to write name on art
Paper grocery bags for trash (painters' tape and paper towels)
Clothespins~class set ($5.00 per 1200 kids)
Scissors (optional)
wholesale pricing is for non-profits only
0.80¢ is with minimum of 10,000 pieces Note: foam puzzle piece is 0.82¢ for 5,000-9,999; 85¢ 1,200-4,999; 0.99¢ for less than 1,200.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A puzzle piece system for use with assembling a puzzle comprising in combination:

at least one puzzle piece comprising a top layer having an upper surface for being separately decorated, and a lower surface;

a foam layer having an upper surface adhered to the lower surface of the top layer, and a lower surface;

an adhesive layer adhered to the lower surface of the foam layer; and a fabric layer having an upper surface attached to the adhesive layer on the lower surface of the foam layer;

separate fasteners consisting of loop fasteners facing rearwardly from a lower surface on the fabric layer; and interlocking portions on sides of the puzzle piece, the interlocking portions comprising at least a cut-out and protruding portion, wherein the interlocking portions allow for a plurality of puzzle pieces to be interlocked with one another solely by the interlocking portions; and a separate vertical frame for allowing the at least one puzzle piece to be displayed in a vertical orientation, the vertical frame including a front surface consisting of hook fasteners for being attachable to the loop fasteners on the lower surface of the puzzle piece, wherein the separate fasteners are used to display the puzzle piece in a vertical orientation from the vertical frame, wherein the separate vertical frame includes a rigid inner frame having a front surface with the hook fasteners attaching to the rearwardly facing loop fasteners on the fabric behind each of the plurality of puzzle pieces for supporting the assembled puzzle pieces therein, and wherein the separate vertical frame further includes a rigid outer frame with an inner compartment for supporting the rigid inner frame therein, and the inner compartment having fasteners consisting of hook fasteners thereon, so that rear surface fasteners consisting of loop fasteners on a back of the rigid inner frame are attachable to the hook fasteners on the inner compartment.

2. The puzzle piece system of claim 1, wherein the top layer includes:

an applied paint, acrylics or latex.

3. The puzzle piece system of claim 1, wherein the top layer includes:

fabric attached to the upper surface of the foam by an adhesive.

4. The puzzle piece of claim 1, wherein the top layer includes:

paper attached to the upper surface of the foam by an adhesive.

5. The puzzle piece system of claim 1, wherein the top layer includes:

designs formed from at least one of alcohol pens or permanent markers.

6. The puzzle piece system of claim 1, further comprising:

a rigid layer between the fabric layer and the foam layer.

7. A mounting system for assembled puzzle pieces, comprising:

a plurality of puzzle pieces interlocked with one another solely by cut-outs and protruding portions, to form an assembled puzzle having a substantially planar exterior surface, each of the puzzle pieces having a rear surface adhered to a front surface of a fabric, the fabric having fasteners consisting of loops extending rearwardly from the fabric;

a rigid inner vertical frame having a front surface with hooks for attaching to the rearwardly extending loops on the fabric behind each of the plurality of puzzle pieces for supporting the assembled puzzle pieces therein; and a rigid outer frame with an inner compartment for supporting the rigid inner frame therein, and the inner compartment having fasteners consisting of hook fasteners thereon, so that rear surface fasteners consisting of loop fasteners on a back of the rigid inner frame are attachable to the hook fasteners on the inner compartment.

8. The mounting system of claim 7, further comprising:

an I shaped attachment having upper and lower horizontal legs with a stem portion therebetween, the upper and lower legs having exterior surfaces with fasteners, selected from at least one of hooks and loops for stacking additional puzzle pieces to an exterior surface of the assembled puzzle.

9. The mounting system of claim 7, further comprising:

clip brackets having a rear surface with hook fasteners thereon which attaches by said hook fasteners to the assembled puzzle pieces, and an opposite clip end which is attachable to edges of a shelf.

10. The mounting system of claim 8, further comprising:

clip brackets having a rear surface with hook fasteners thereon which attaches by said hook fasteners to the assembled puzzle pieces, and an opposite clip end which is attachable to edges of a shelf.

11. The mounting system of claim 7, further including:

an L shaped bracket having an exterior portion with hooks for attaching the L shaped bracket to the rear surface of the fabric of at least one selected puzzle piece, the L shaped bracket being adapted to be attached to corners of a support surface.

12. The mounting system of claim 8, further including:

an L shaped bracket having an exterior portion with hooks for attaching the L shaped bracket to the rear surface of the fabric of at least one selected puzzle piece, the L shaped bracket being adapted to be attached to corners of a support surface.

13. The mounting system of claim 9, further including:

an L shaped bracket having an exterior portion with hooks for attaching the L shaped bracket to the rear surface of the fabric of at least one selected puzzle piece, the L shaped bracket being adapted to be attached to corners of a support surface.

14. The mounting system of claim 7, wherein each of the puzzle pieces includes:

a top layer having an upper surface for being separately decorated, and a lower surface;

a foam layer having an upper surface adhered to the lower surface of the top layer, and a lower surface;

an adhesive layer adhered to the lower surface of the foam layer; and the fabric layer having an upper surface attached to the adhesive layer on the lower surface of the foam layer, wherein the top layer and the foam layer and the adhesive layer and the fabric layer have perimeters solely with interlocking portions comprising cut-outs and protruding portions to allow the puzzle piece to be interlocked other puzzle pieces.

15. The mounting system of claim 14, wherein each of the puzzle pieces includes: a rigid layer between the fabric layer and the foam layer.

* * * * *